United States Patent [19]

Kefalos

[11] 3,961,590

[45] June 8, 1976

[54] CATAMARAN WATERCRAFT

[76] Inventor: Gust Kefalos, 523 E. Railroad Ave., Verona, Pa. 15147

[22] Filed: Sept. 19, 1974

[21] Appl. No.: 507,281

[52] U.S. Cl. ..... 114/61; 114/123

[51] Int. Cl.[2] ..... B63B 1/12

[58] Field of Search ..... 114/61, 123, 66.5 F, 114/.5 F, 39, 66.5 R

[56] References Cited

UNITED STATES PATENTS

| | | | |
|---|---|---|---|
| 2,106,432 | 1/1938 | McIntyre | 114/61 |
| 2,984,845 | 5/1961 | Gregoire | 114/61 |
| 3,116,708 | 1/1964 | Gardhouse | 114/39 |
| 3,232,261 | 2/1966 | Graig | 114/123 |
| 3,265,026 | 8/1966 | Hamilton | 114/123 |
| 3,310,019 | 3/1967 | Standridge et al. | 114/123 |
| 3,566,819 | 3/1971 | Keddie | 114/61 |

FOREIGN PATENTS OR APPLICATIONS

| | | | |
|---|---|---|---|
| 201,350 | 7/1954 | Australia | 114/61 |

*Primary Examiner*—Stephen G. Kunin
*Assistant Examiner*—Stuart M. Goldstein
*Attorney, Agent, or Firm*—Parmelee, Miller, Welsh & Kratz

[57] ABSTRACT

A catamaran watercraft having a pair of parallel pontoons which pivot along their respective longitudinal axes. The pontoons are each preferably triangular in cross section, having a planar bottom surface and a linear top surface forming the longitudinal axis of rotation. A deck is hingedly supported by the linear top surface of each pontoon so as to be pivotable about the longitudinal axis of the pontoon. A control bar member or control wheel is included for simultaneously pivoting the pontoons relative to the deck. The rotational movement of the pontoons provides directional control of the watercraft without the use of a rudder.

7 Claims, 7 Drawing Figures

CATAMARAN WATERCRAFT

BACKGROUND OF THE INVENTION

1. Field of the Invention

This invention relates generally to watercraft of the catamaran type which are supported by a pair of hulls or pontoons, and more specifically to such craft which are steerable by longitudinal rotation of the pontoons as opposed to by a standard rudder.

2. Prior Art

Watercraft of the catamaran type which are supported by a pair of parallel hulls or pontoons have become quite common in boating, particularly in smaller boats primarily used for pleasure boating. The primary advantage of boats built in catamaran style is the stability offered by the spaced hulls without the excess drag which would be caused by one wide hull. However, such watercraft have normally been operated in otherwise normal fashion through the use of a rudder to provide for directional control. It is an object of the present invention to provide a watercraft which has directional control through the rotational movement of the pontoons themselves rather than through the use of a separate rudder.

SUMMARY OF THE INVENTION

The present invention is a watercraft of the catamaran type having a pair of parallel pontoons, each of which has a planar bottom surface and a linear top surface forming a longitudinal axis of rotation. The pontoons are each preferably of triangular cross-section. A deck is supported by the top surface of each of the pontoons, and is secured to each pontoon so as to be pivotable about the longitudinal axis of that pontoon. Control means are provided for pivoting the pontoons relative to the deck, such that rotational movement of either pontoon about its longitudinal axis causes a correlative rotational movement of the other pontoon about its longitudinal axis. The control means may comprise a pair of elongated members, each of which is attached to one of the pontoons and extends upward perpendicular to the axis of rotation of that pontoon, and a third member interconnecting the pair of elongated members. Alternatively, the control means may comprise an elongated member attached to one of the pontoons, extending upward perpendicular to the axis of that pontoon, and a rigid coupling member interconnecting the pontoons. In another embodiment, the control means includes a wheel, and flexible coupling means secured to the wheel and to the pontoons, such that rotation of the wheel causes rotational movement of both pontoons.

DESCRIPTION OF THE PREFERRED EMBODIMENT

Figure 3:
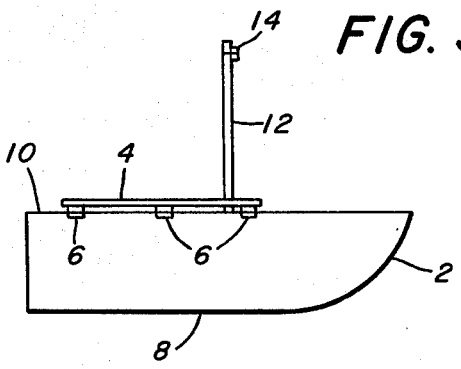
FIG. 3 is a side elevation view of the watercraft shown in FIG. 1.
Figure 4:
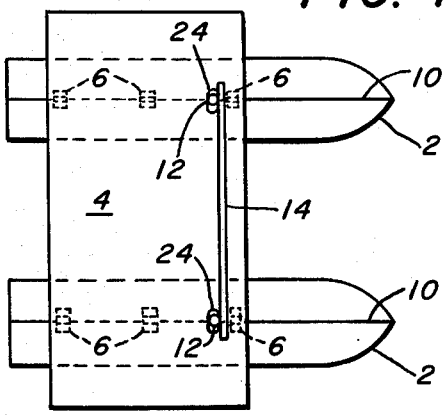
FIG. 4 is a plan view of the watercraft shown in FIG. 1.

The watercraft of the present invention includes a pair of pontoons 2 hingedly connected to a deck 4. The deck 4 may be secured to the pontoons 2 by any appropriate hinged connector such as standard hinges 6, as shown in FIGS. 3 and 4. If standard hinges having removable pins are used, the watercraft may be disassembled for easy transportation, such as on the top of an automobile. The deck 4 may be of any desired size or shape, and is shown in the drawings as a standard 4 × 8 feet sheet of plywood.

Figure 1:
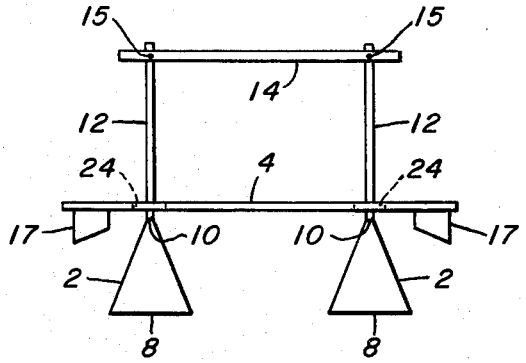
FIG. 1 is a rear elevation view of one embodiment of a catamaran watercraft of the present invention.
Figure 2:
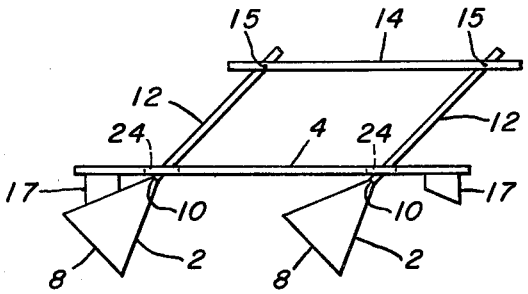
FIG. 2 is a figure similar to FIG. 1, showing the pontoons of the watercraft of FIG. 1 in position for making a right turn.

Each pontoon 2 is shaped so as to have a planar lower surface 8 and a linear upper surface 10. The planar lower surface 8 may have small ridges or grooves therein and still be encompassed by the term planar as applied to this invention. Similarly, the linear upper surface 10 need not be exactly linear, but rather must be substantially linear so as to allow free movement of the pontoons 2 relative to the deck 4. In the preferred embodiment, as shown in the drawings, the pontoons 2 have a triangular cross-section, as shown in FIGS. 1 and 2, the cross-section preferably being an isoceles triangle having sides longer than the base. This triangular cross-section exists throughout the pontoon although the planar lower surface 8 comes up to meet the linear upper surface 10 to form a standard bow shape, as shown in FIG. 3. The bow of each of the pontoons may be shaped in various ways within the scope of this invention without altering the basic cross-section of the pontoon 2.

The linear upper surface 10 of the pontoon 2, where the pontoon 2 is hingedly affixed to the deck 4, forms a longitudinal axis of rotation for the pontoon 2. Each pontoon 2 is able to be rotated about this axis and therefore change its position relative to the deck 4. Control means are provided for pivoting the pontoons relative to the deck 4 about their longitudinal axes. The control means may take the form shown in FIG. 1, wherein an elongated member 12 is secured to each pontoon 2 extending upward perpendicular to the axis of rotation of the pontoon 2. Thus movement of elongated member 12 will cause corresponding rotational movement of pontoon 2 about its axis and relative to the deck 4. The two elongated members 12 are interconnected by a third member 14 so that rotational movement of either pontoon 2 about its longitudinal axis causes a correlative rotational movement of the other pontoon 2 about its longitudinal axis. The interconnecting member 14 is secured to the elongated members 12 by pivots 15, so that interconnecting member 14 remains parallel to the deck 4 even when elongated members 12 are tilted to one side. Thus, when interconnecting member 14 is moved horizontally, the parallelogram linkage formed by the deck 4, the elongated members 12, and the interconnecting member 14 pivoting on pivots 15 and hinges 6 will cause rotational movement of the pontoons 2. If desired, the rotational movement of the pontoons 2 can be limited by limiting means such as blocks 17, as shown in FIGS. 1 and 2.

This will, in turn, limit the degree of turn which the watercraft is capable of making.

Figure 6:
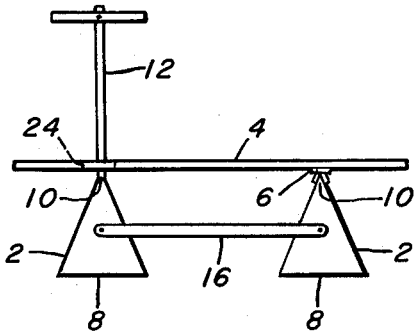
FIG. 6 is a view similar to FIG. 1, showing an alternative embodiment of the control means of the catamaran watercraft of the present invention.
Figure 7:
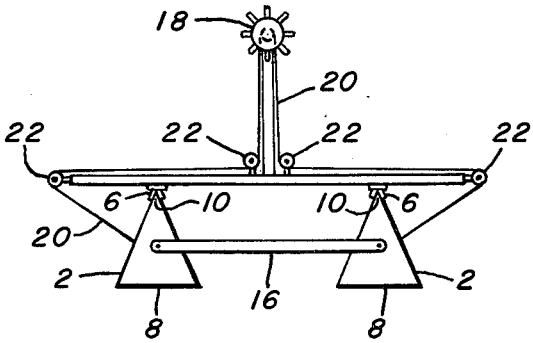
FIG. 7 is a view similar to FIG. 1, showing an alternative embodiment of the control means of the catamaran watercraft of the present invention.

It should be pointed out that there are other ways in which the control means for pivoting the pontoons and causing correlative rotational movement thereof can be formed. For example, in FIG. 6 one elongated member 12 is connected to one of the pontoons 2, and a horizontal member 16 interconnects the two pontoons 2. Thus, a tilting movement of the elongated member 12 will cause direct rotational movement of one pontoon 2 and, through horizontal member 16, will also cause correlative rotational movement of the other pontoon 2. Another manner in which the means for pivoting the pontoons may be formed is shown in FIG. 7, wherein a wheel 18 is connected by flexible coupling means, such as cables 20, running through pulleys 22 to the pontoons 2. The pontoons 2 are interconnected either by further cable 20 or by horizontal member 16, such that rotation of the wheel 18 causes rotational movement of the pontoons 2 about their respective longitudinal axes.

In operation, the watercraft described herein may be powered by any sort of motive means, which motive means have not been shown in the drawings since they are not considered to form a part of this invention. For example, a motor or sail can be attached in any one of numerous ways in order to provide motive power for the watercraft. The novel design of the watercraft of the present invention does not require a rudder, but rather the watercraft is steered by movement of the pontoons 2 relative to the deck 4. For example, with the pontoons 2 in the position relative to the deck 4, as shown in FIG. 1, the craft would proceed in a straight line parallel to the longitudinal axes of the pontoons 2. If a right turn were desired, the pontoons 2 would be pivoted relative to the deck 4 as shown in FIG. 2 (The direction of movement of the craft in this case is assumed to be into the plane of the paper.). The water acting upon the tilted pontoons 2 causes the craft to proceed to the right, the degree of turn being determined by the amount of rotation of the pontoons 2 relative to the deck 4. If a left turn is desired, the pontoons 2 would be moved in the opposite direction.

Figure 5:
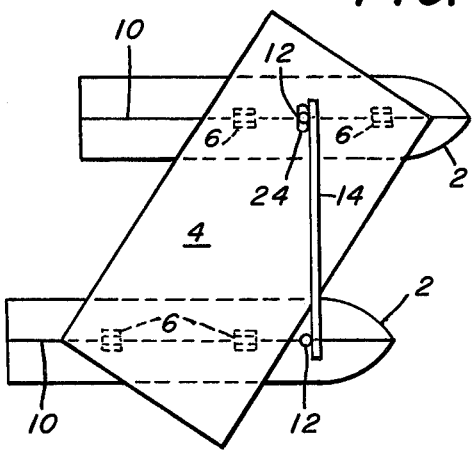
FIG. 5 is a plan view of another embodiment of the catamaran watercraft of the present invention.

The parallel pontoons 2 may be arranged in a "rectangular" orientation, such as shown in FIG. 4, or they may be arranged in a "parallelogram" orientation with the pontoons 2 being longitudinally displaced relative to each other, as shown in FIG. 5. In either orientation, the deck may be secured to the pontoons either perpendicular to the axes of rotation, as shown in FIG. 4, or in a diagonal manner, as shown in FIG. 5. The longitudinal displacement of the pontoons 2, as shown in FIG. 5, may be desired in order to increase the stability of the watercraft relative to oncoming waves.

As previously stated, the deck 4 may be of various sizes and shapes. If the deck 4 covers one or more of the points of attachment of the elongated members 12 to the pontoons 2, slots 24 may be required through the deck 4 through which the elongated members 12 may pass. The length of these slots 24 will be determined by the space necessary to provide for the tilting motion of elongated members 12 upon steering the craft, as shown in FIG. 2.

The watercraft of the invention is also useful as a towed craft whereby persons who are, for example, unskilled or otherwise physically unable to participate in the usual forms of water skiing, may enjoy at least some of the pleasures akin to water skiing without special training and with relative safety. The watercraft is, of course, afloat even when at rest so that the towing speed can be virtually any speed desired. This, coupled with the fact that the deck remains substantially horizontal at all times, provides a very safe and convenient craft for enjoyment by the active athletic person as well as by the very young or old or infirm who might not otherwise be able to enjoy participation in water sports.

There has been described a novel watercraft of the catamaran type which includes a pair of parallel pontoons and means for controlling the rotational movement of these pontoons. This controlled rotational movement of the pontoons provides directional control of the watercraft without use of a separate rudder.

I claim:

1. A watercraft of the catamaran type comprising:

a pair of parallel pontoons, each pontoon having a substantially linear top surface forming a longitudinal axis of rotation, and widening downwardly and outwardly to a larger substantially planar bottom surface, with the bow portion of the bottom surface curving upward;

a deck supported by the top surface of each of the pontoons and secured to each pontoon so as to be pivotable about the longitudinal axis of that pontoon; and control means attached to the pontoons for pivoting the pontoons relative to the deck such that rotational movement of either pontoon about its longitudinal axis causes a correlative rotational movement of the other pontoon about its longitudinal axis, whereby the rotation of the pontoons serves as the primary steering means for the watercraft.

2. A watercraft as defined in claim 1 wherein each of the pontoons is of triangular cross-section.

3. A watercraft as defined in claim 1 wherein the pontoons are relatively displaced longitudinally.

4. A watercraft as defined in claim 1 wherein the deck remains substantially horizontal when the pontoons are pivoted relative to the deck.

5. A watercraft as defined in claim 1 wherein the control means comprises a pair of elongated members, each of which is attached to one of the pontoons, and extends upward perpendicular to the axis of rotation of that pontoon, and a third member interconnecting the pair of elongated members.

6. A watercraft as defined in claim 1 wherein the control means comprises an elongated member, attached to one of the pontoons and extending upward perpendicular to the axis of that pontoon, and a rigid coupling member interconnecting the pontoons.

7. A watercraft as defined in claim 1 wherein the control means comprises a wheel, and flexible coupling means secured to the wheel and to the pontoons such that rotation of the wheel causes rotational movement of both pontoons.

* * * * *